US007382686B2

(12) United States Patent
Innes

(10) Patent No.: US 7,382,686 B2
(45) Date of Patent: Jun. 3, 2008

(54) DRILLING SIGNALLING SYSTEM

(75) Inventor: Frank Innes, Dyce (GB)

(73) Assignee: Geolink (UK) Ltd., Aberdeen (GB)

( * ) Notice: Subject to any disclaimer, the term of this patent is extended or adjusted under 35 U.S.C. 154(b) by 750 days.

(21) Appl. No.: 10/466,984

(22) PCT Filed: Jan. 22, 2002

(86) PCT No.: PCT/GB02/00268

§ 371 (c)(1),
(2), (4) Date: Feb. 19, 2004

(87) PCT Pub. No.: WO02/059459

PCT Pub. Date: Aug. 1, 2002

(65) Prior Publication Data

US 2005/0034454 A1 Feb. 17, 2005

(30) Foreign Application Priority Data

Jan. 24, 2001 (GB) ..... 0101803.5
Mar. 5, 2001 (GB) ..... 0105313.1

(51) Int. Cl.
*H04H 9/00* (2006.01)

(52) U.S. Cl. ..... 367/85; 340/854.4; 367/83

(58) Field of Classification Search ..... 367/85, 367/83; 340/855.7, 854.4
See application file for complete search history.

(56) References Cited

U.S. PATENT DOCUMENTS 5,040,155 A 8/1991 Feld
5,103,430 A 4/1992 Jeter et al.
5,117,398 A 5/1992 Jeter
5,473,579 A 12/1995 Jeter
6,016,288 A 1/2000 Frith
7,145,834 B1 * 12/2006 Jeter ..... 367/83

* cited by examiner

*Primary Examiner*—Albert K. Wong
(74) *Attorney, Agent, or Firm*—Kirton & McConkie; Evan R. Witt

(57) ABSTRACT

A pressure pulse generator for use in transmitting pressure signals to surface in a fluid-based drilling system having a housing having an inlet to admit drilling fluid to the interior of housing, and an outlet to discharge fluid from the interior of the housing; a control element slidably mounted in the housing between an open and a closed position, the control element generating a pressure pulse in the supply of pressure fluid when the control element takes-up the closed position; a control passage extending through the control elements and closable by a pilot valve element exposed to the pressure of the fluid in the passage; and an actuator coupled with the valve element to generate a pressure signal, to move the valve element to a position closing said passage and thereby to cause movement of the control element towards the closed position; the coupling between the actuator and the valve element includes a yieldable biassing element which provides control of the amplitude of the pressure signals produces by the generator.

11 Claims, 4 Drawing Sheets

DRILLING SIGNALLING SYSTEM

This invention relates to a system of communication employed during the drilling of boreholes in the earth for purposes such as oil or gas exploration and production, the preparation of subterranean services ducts, and in other civil engineering applications.

Taking the drilling of oil and gas wells as an example, it is highly desirable both for economic and for engineering reasons, to obtain information about the progress of the borehole and the strata which the drilling bit is penetrating from instruments positioned near the drilling bit, and to transmit such information back to the surface of the earth without interruption to the drilling of the borehole. The generic name associated with such techniques is "Measurement-while-Drilling" (MWD). Substantial developments have taken place in MWD technology during the last twenty-five years.

One of the principal problems in MWD technology is that of reliably telemetering data from the bottom of a borehole, which may lie several thousand metres below the earth's surface. There are several established methods for overcoming this problem, one of which is to transmit the data, suitably encoded, as a series of pressure pulses in the drilling fluid; this method is known as "mud pulse telemetry".

A typical arrangement of a mud pulse MWD system is shown schematically in FIG. 1. A drilling rig (50) supports a drillstring (51) in the borehole (52). Drilling fluid, which has several important functions in the drilling operation, is drawn from a tank (53) and pumped, by pump (54) down the centre of the drillstring (55) returning by way of the annular space (56) between the drillstring and the borehole (52). The MWD equipment (58) that is installed near the drill bit (59) includes a means for generating pressure pulses in the drilling fluid. The pressure pulses travel up the centre of the drilistring and are received at the earth's surface by a pressure transducer (57). Processing equipment (60) decodes the pulses and recovers the data that was transmitted from downhole.

In one means of generating pressure pulses at a downhole location, the fluid flowpath through the drillstring is transiently restricted by the operation of a valve. This creates a pulse, the leading edge of which is a rise in pressure; hence the method is colloquially, although rather loosely, known as "positive mud pulse telemetry". In contradistinction the term "negative mud pulse telemetry" is used to describe those systems in which a valve transiently opens a passage to the lower pressure environment outside the drillstring, thus generating a pulse having a falling leading edge.

Devices for the generation of pulses for positive mud pulse telemetry have been described in, for example, U.S. Pat. Nos. 3,958,217, 4,905,778, 4,914,637 and 5,040,155. The above references represent only a few of the very many pulse generating devices that have been developed over a relatively long period of time.

In U.S. Pat. No. 5,040,155, there is described a type of fluid pulse generator in which the operating energy is derived by creating a pressure drop in the flowing drilling fluid: this differential pressure is used to actuate a main valve element under the control of a pilot valve.

The present application describes an invention which advantageously controls the amplitude of the pressure pulse in a pulser of a generally similar type to that described in U.S. Pat. No. 5,040,155.

According to the invention there is provided a pressure pulse generator as defined in claim 1.

The biasing element may comprise a compliant spring or other suitable biasing device, and enables greater control of the amplitude (height) of the pressure signals which are produced, despite the possible variations which occur in practice in the pressure of the fluid which is provided to operate a drilling system.

Figure 3:
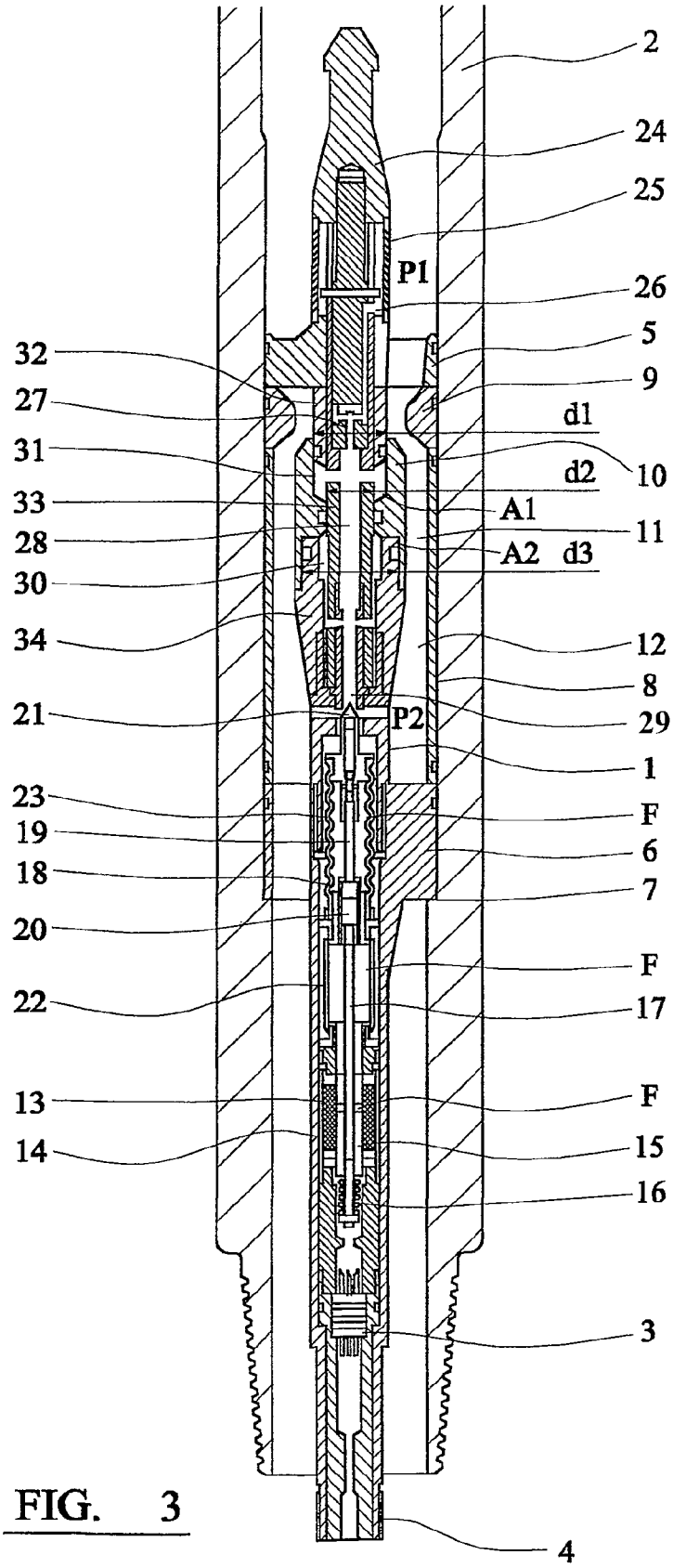
FIG. 3 is a view, similar to FIG. 2, of a preferred embodiment of pressure pulse generator according to the invention.
Figure 3A:
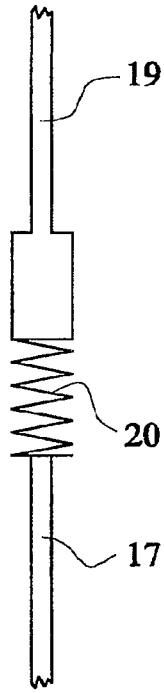
Figure 4:
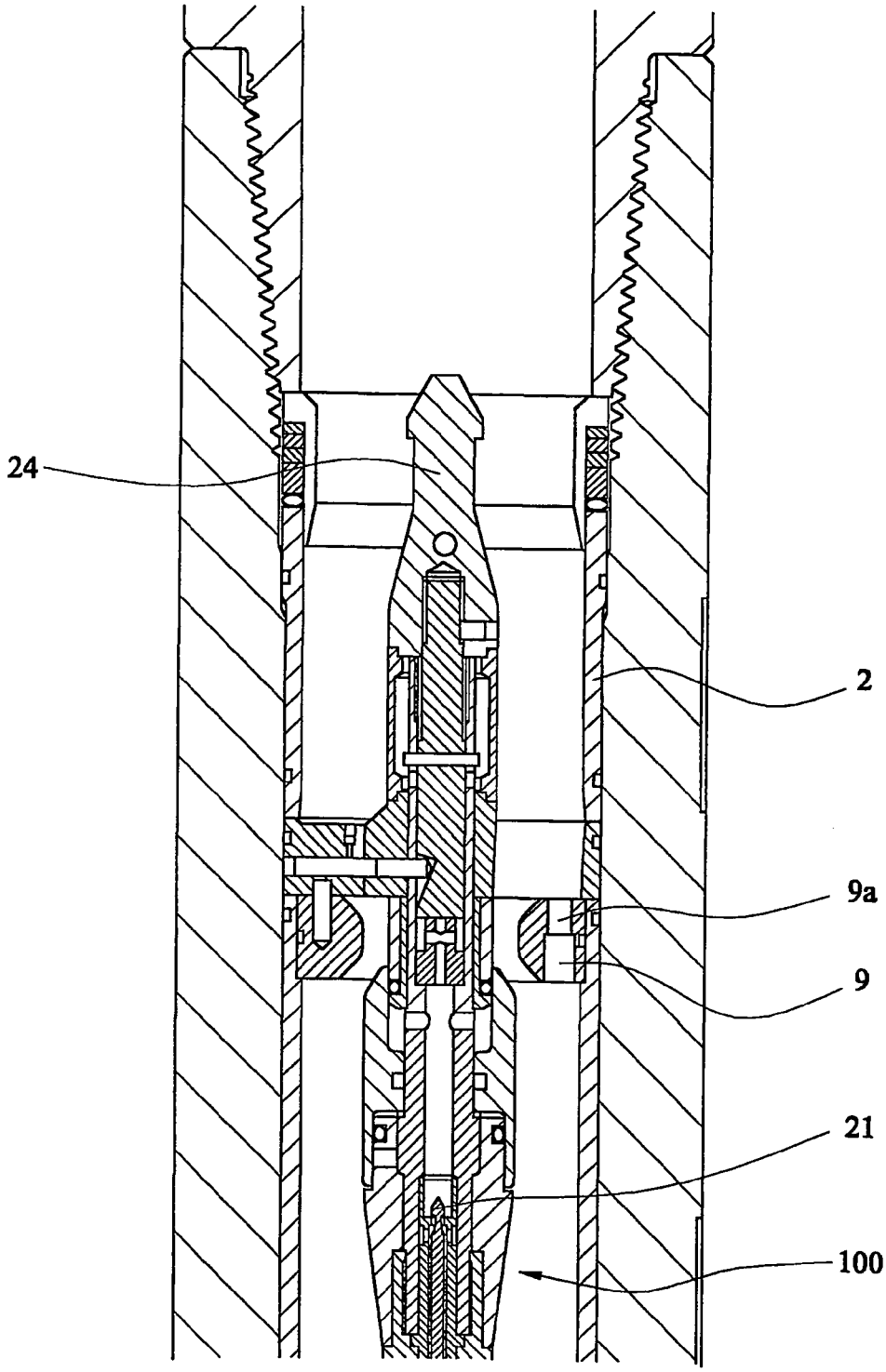

FIG. 3*a* is a detail view of part of FIG. 3 and showing a resilient biassing arrangement provided in a 2 part actuator link extending between an electromagnetic actuator and a pilot valve; and, FIG. 4 is a detail view of a modified inlet arrangement to the pressure pulse generator of FIG. 3.

Figure 2:
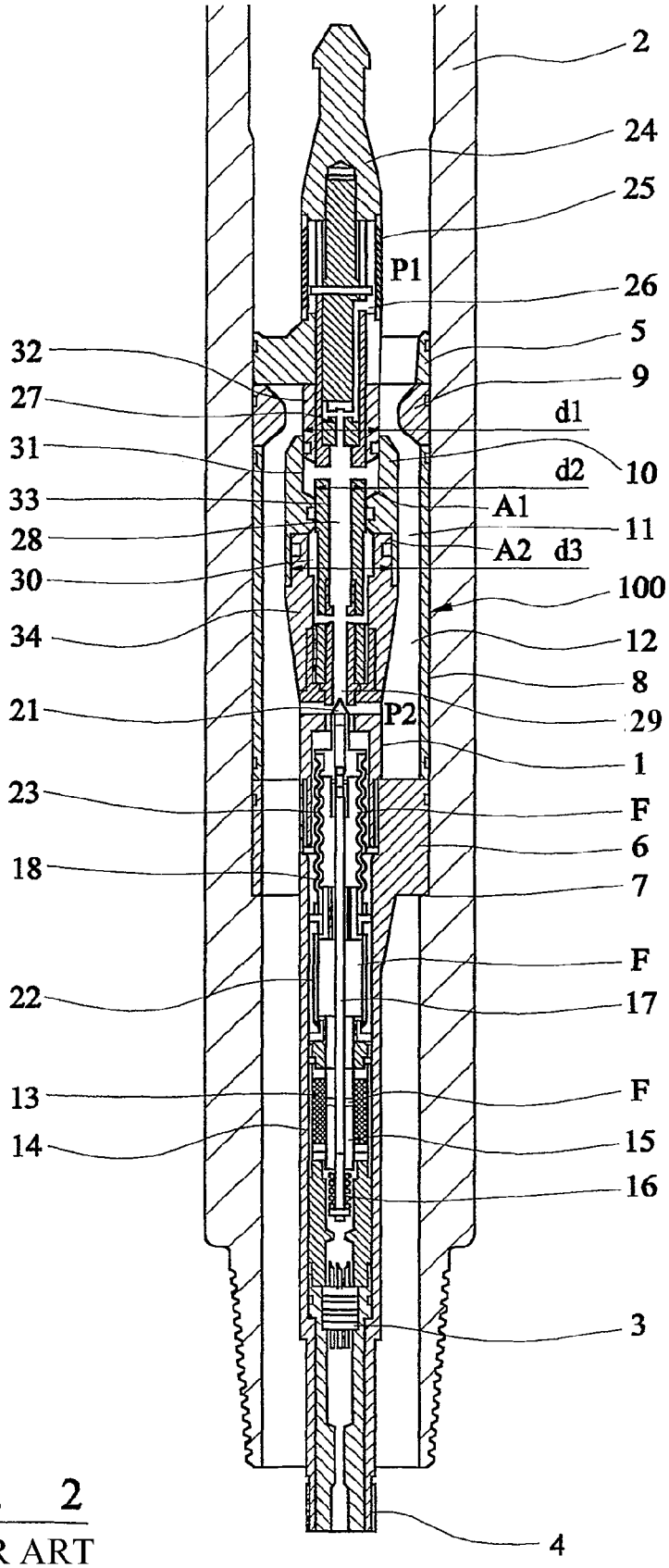
FIG. 2 PRIOR ART
FIG. 2 is a detailed illustration of a pressure pulse generator of known design, which will be described to provide background to the invention.

First, the basic construction and operation of a known pulse generator will be reviewed with reference to FIG. 2 of the accompanying drawings. This will serve to make clearer the advantages of the invention which will be detailed in the second part of the description, with reference to a preferred embodiment shown in FIG. 3 of the accompanying drawings.

FIG. 2 shows a cross-section of a generally cylindrical pressure pulse generating device. The pulse generator 1 is installed in a drill string 2 of which only a part is shown. The flow of drilling fluid within the drill string is downwards in relation to the drawing orientation. The pressure pulse generator is shown terminated by electrical and mechanical connectors 3 and 4 respectively, for the connection of other pressure housings which would contain, for example, power supplies, instrumentation for acquisition of the data to be transmitted and a means for controlling the operation of the pulse generator itself. Such sub-units form a normal part of an MWD system and will not be further described herein.

The pulse generator has an outer housing designated generally by reference 100 which is mounted and supported in the drill string element 2 by upper and lower centraliser rings 5 and 6 respectively. The centralisers have a number, typically three, of radial ribs between an inner and outer ring. The spaces between the ribs allow the passage of drilling fluid. The ribs may be profiled in such a way as to minimise the effects of fluid erosion. The lower centraliser 6 rests on a shoulder 7 in the drill string element. A spacer sleeve 8 supports a ring 9 and protects the bore of the drill string element from fluid erosion. The ring 9 together with a main valve element 10 define an inlet arrangement to the housing 100 and which will be described in more detail later, and form a significant restriction to the passage of fluid. The pulse generator is locked into the drillstring element 2 by conventional means (not shown) to prevent it rotating or reciprocating under the influence of shock and vibration from the drilling operation.

Considering for the moment only the main flow, drilling fluid, supplied from the previously described storage tanks and pumps at surface, passes the upper centraliser 5, the ring 9, a main valve assembly 11 and the lower centraliser 6 before proceeding downwardly via an outlet arrangement of the housing 100 and towards the drill bit. As is well known, the drilling fluid returns to surface by way of the annular space between the drilling assembly and the generally cylindrical wall of the hole being created in the earth by the drill bit.

The flow of drilling fluid through the restriction formed by the ring 9 and the main valve element 10 creates a significant pressure drop across the restriction. The absolute pressure at a point P1 is principally composed of the hydrostatic pressure due to the vertical head of fluid above that point together with the sum of the dynamic pressure losses created by the flowing fluid as it traverses all the remaining parts of the system back to the surface storage tanks. There are other minor sources of pressure loss and gain which do not need to be described in detail here. It should be noted that the surface pumps are invariably of a positive displacement type and therefore the flow through the system is essentially constant for a given pump speed, provided that the total resistance to flow in the whole system also remains essentially constant. Even when the total resistance to flow does change, the consequent change in flow is relatively small, being determined only by the change in the pump efficiency as the discharge pressure is raised or lowered, provided of course that the design capability of the pumps is not exceeded.

Figure 1:
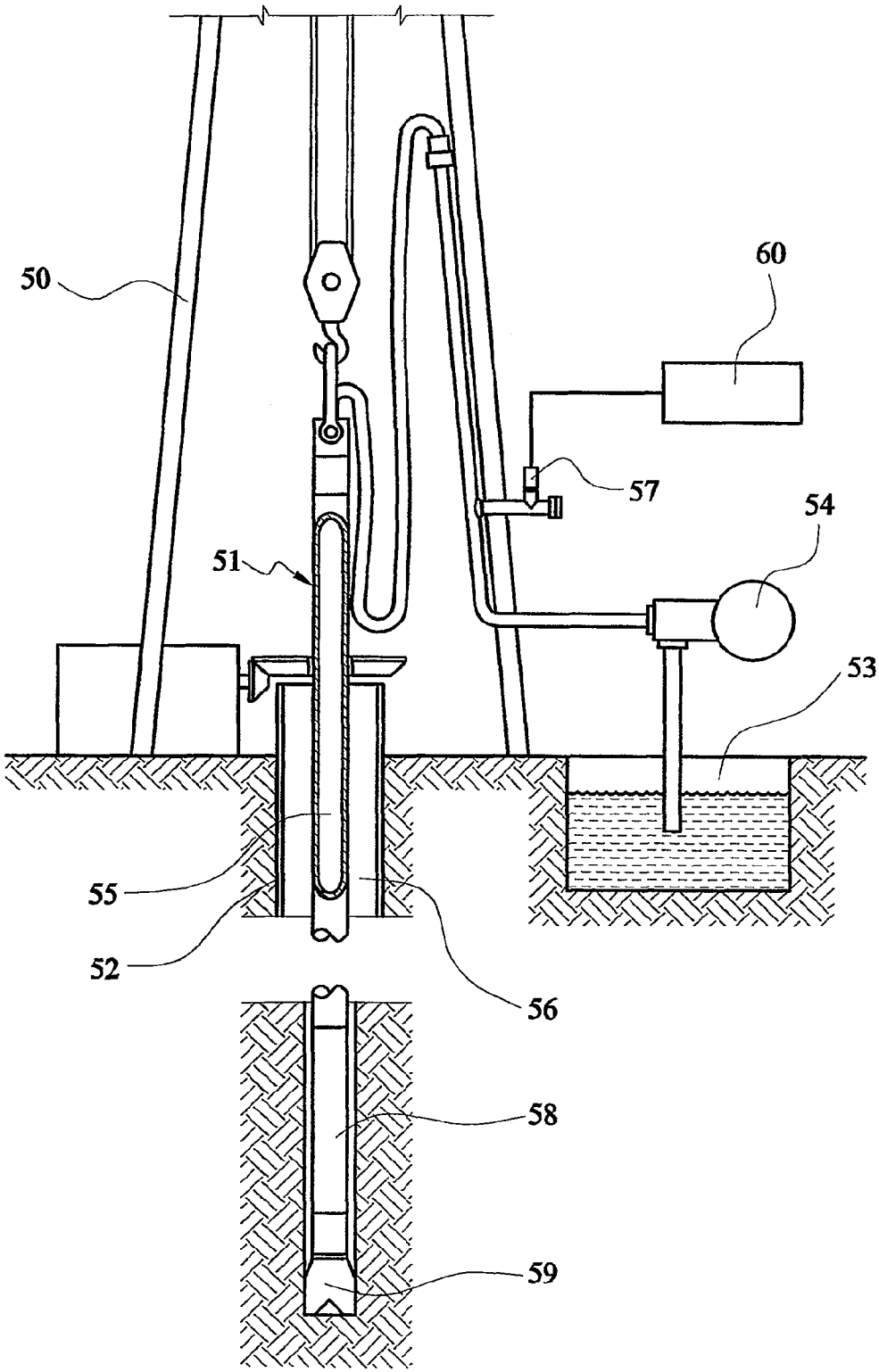
FIG. 1 PRIOR ART
FIG. 1 is a schematic illustration of a typical drilling installation with which a pressure pulse generator according to the invention may be used.

The pressure at a point such as P2 is lower than that at P1 only by the pressure loss in the restriction described above, the change in hydrostatic head being negligible in comparison with the vertical height of the wellbore. Although some pressure recovery occurs, as is well known, in the region where the flow area widens out, at 12 in FIG. 1, the main restriction at the ring 9 and the main valve 10 nevertheless causes a clear pressure differential, proportional approximately to the square of the flow rate, to appear across the points indicated.

The inner assembly contains an electromagnetic actuator with coil 13, yoke 14, armature 15, and return spring 16. A shaft 17 connects the actuator to a pilot valve element 21, and extends continuously as a solid link from the actuator to the valve element.

As is customary in apparatus of this kind, there are parts of the assembly that are preferably to be protected from ingress of the drilling fluid, which usually contains a high proportion of particulate matter and is electrically conductive. In FIG. 2 the volumes indicated by the letter F are filled with a suitable fluid such as a mineral oil, and there is communication between these volumes by passageways and clearances not shown in detail. It is important for the operation of the pulse generator that the pressure in the oil-filled spaces should be held always equal to that of the drilling fluid surrounding it. Were this not so, the differential pressure between the two regions would lead to an unwanted axial force in one or other direction on shaft 17. The compliant element 22 provides this pressure equalising function, as does the compliant bellows 23. Between them these two elements allow the internal volume of the oil-filled space to change, either by expansion of the oil with temperature, or by axial movement of the bellows, without significantly affecting the force acting on shaft 19. This volume-compensated oil fill technique is well known.

At the top of the pulse generator there is a probe 24 that carries a cylindrical filter element 25. (The profile of the top of the probe is designed to allow a retrieval tool to be latched to it, and is not otherwise significant to the subject of this application.)

There is fluid communication from the inside of the filter 25 through the passages 26, 27, 28 to the orifice 29 immediately above the pilot valve element 21. This fluid is also in communication with the space 30 below the main valve element 10 and the space 31 above the main valve element.

The main valve element 10 is slideably mounted on the structural parts of the assembly 32, 33, 34. It is to be noted that the effective operating areas, upon which a normally directed force component may cause the valve to move are the ring-shaped areas denoted as A1 and A2 in FIG. 2. Area A1 is defined by the diameters shown as d1 and d2. Area A2 is defined by the diameters shown as d2 and d3

When fluid flows through the pulse generator, a small portion of the flow bypasses the main flow areas and passes through the filter 25 and the passageways 26, 27, 28 to a pilot valve orifice 29 (closable by movement of the pilot valve 27 under action of the actuator assembly 17, 13, 14, 15, 16). Passageway 27 forms a restriction controlling this pilot flow and ensuring that the pressure in passageway 28 is substantially less than the pressure P1. In this condition the pulse generator is inactive. The pressure in passageway 28 is communicated both to area A1 and area A2. The areas A1 and A2 are chosen so that the product (pressure in passageway 28)×(A2−A1) is insufficient to overcome the downwardly directed hydrodynamic force, caused by the main fluid flow, and the main valve element 10 remains in its rest position.

To cause a pressure pulse to be generated in the main flow, the coil 13 is energised and the armature 15 moves upwards. This motion is transmitted to the shaft 17 and the pilot valve 21, which is carried upwards until it closes the pilot orifice 29.

The closure of the pilot orifice stops the pilot flow and as a result the pressure throughout the set of passageways below the filter element 25 rises to the same value as the pressure at the exterior of the filter, the pressure P1. This pressure is applied to the areas A1 and A2, and since area A2 is substantially larger than A1 a net upwards force is applied to the main valve element 10. This force is sufficient to overcome the hydrodynamic resistance to movement and the valve element 10 moves upwards to increase the restriction offered to flow at the inlet area between it and the ring 9. Because the flow remains essentially constant, as described earlier, the pressure P1 now rises substantially. This change in pressure is detectable at the surface of the earth and forms the leading edge of a data pulse. When the coil 13 is de-energised, the forces provided by the pressure drop across the pilot valve and by the return spring 16 move the pilot valve back to its rest position. The net force on the main valve element is reversed in direction and the valve returns to the quiescent position described earlier. The excess pressure is relieved and the pressure change detected at surface forms the trailing edge of the data pulse.

In the basic form described above the pulse generator operates generally according to the principles described in U.S. Pat. No. 5,040,155.

The present invention provides a much improved control of the amplitude of the pressure pulse generated in the wellbore when compared with the prior art, as will now be described, with reference to a preferred embodiment shown in FIG. 3.

This invention is equally applicable when it is used in conjunction with mechanism for improving performance and wear resistance in solids-bearing fluids described in our co-pending UK patent application No 0101802.7.

It will be noted that in the basic form of the device described above, the operation of fully closing the pilot valve 21 causes the pressure acting on area A2 to remain the same as the pressure P1. The operation of the main valve causes pressure P1 to increase significantly, as described above, thus increasing the force tending to close the main valve 10. This positive feedback has the effect of largely offsetting the increase in drag forces experienced by the main valve element. Consequently the amplitude of the pressure change induced by the operation of the pulse generator tends to increase very substantially with flow rate.

It is stated in U.S. Pat. No. 5,040,155 that the main valve element can be configured in such a way that when the pulse generator is activated, the main valve element will come to rest in an intermediate position in which the main flow continues to pass through the reduced annular area between the ring 9 and the main valve element 10. This is indeed so, but that fact alone does not determine the final amplitude of the generated pulse.

It is particularly desirable that a fluid pulse generator for use in MWD applications should provide stable pulsing characteristics over as wide as possible a range of drilling conditions and thus not act as any kind of constraint on the optimisation of such matters as flow rate and drilling fluid properties. It is well known in the field of drilling technology that there are many competing engineering factors that determine the choice of conditions for a particular part of a wellbore. The presence of instrumentation, such as MWD in the drill string, should have only a minimum effect on the freedom of choice drilling parameters.

Although in any given drilling situation a certain minimum pulse amplitude is needed so that the pulse will be detectable at the earth's surface, it is unsatisfactory for the pulse to be made too large; the imposition of a succession of severe flow restrictions can stress or damage the drilling equipment and may cause the maximum pressure rating of the surface pumping equipment to be transiently exceeded. Furthermore, when mud pressure pulses are too large, significant pulse reflections occur at discontinuities in the process pipework. In particular a pulse can return to the lower end of the drillstring, be reflected, return to surface and be detected, incorrectly, as a data pulse.

In order to keep pulse heights within acceptable limits, some types of pulse generator have to be physically adjusted to suit a particular combination of flow rate and type. This typically involves replacing parts of the downhole system, and is time consuming and expensive. There are cases too, in which for unexpected reasons, the planned flowrates for a particular well section have to be changed while the equipment is downhole. Removing the drilling equipment from the wellbore is generally very time consuming and expensive, and to do so solely to make a change in the operating characteristic of a part of the downhole system would be extremely inefficient. It is therefore very desirable to provide a single system which will operate satisfactorily over a wide range of drilling fluid flowrates. This makes for simplicity of the equipment and allows for flexibility in the drilling operation.

In a basic, uncompensated, pulse generating system of the known general type described above, it could be expected that the pulse amplitude would be roughly proportional to the square of the flow rate but with an offsetting effect due to the increased drag force mentioned above.

In a test of a pulse generator built as described above, the actual amplitude of the pressure pulse varied, to a reasonable approximation, according to $(\text{flow rate})^{1.75}$. It would not be unreasonable in a practical drilling operation to wish to use the same, unadjusted MWD equipment over a flow range of at least 3:1. With an uncompensated system this implies a pulse pressure range of almost 7:1. With a minimum detectable pulse amplitude of, say, 4 bar (a modest requirement in some deep wells) the amplitude of the generated pulse would become 28 bar at the higher flow rate. This is large enough to interfere seriously with the drilling operation and cause excessive wear on the pulse generating equipment. Alternatively a desirable pulse amplitude of 4 bar at the maximum flow rate would become 0.6 bar at the lower, which will be insufficient for detection in most circumstances.

Returning now to the description of operation, the preferred embodiment of the present invention will be described in detail, with reference to FIG. 3, and parts corresponding to those already described are given the same reference numerals.

A control element in the form of a spring or other compliant device 20 is interposed between the actuator shaft 17 and the pilot valve head 21 i.e. there is no longer a solid link between the actuator and the pilot valve, as in FIG. 2.

Spring 20 is contained in housing 18 and acts against an increased diameter section of a rod 19 connected to the valve 21. Thus even when the coil 13 is energised and the armature 15 is in contact with the yoke 14, the valve 21 can take up an independent position intermediate between its rest position and full closure. Therefore, the spring 20 is one example of a resilient biassing means, (provided in an actuator link between the actuator (13, 14, 15) and the pilot valve 21), and which is effective to control the amplitude of the pressure signals produced by the generator as described later.

When the coil 13 is energised to initiate a pulse, the valve 21 is forced against the seat 29 through the intermediary of the spring 20. The main valve element 10 starts to move upward as previously described, and as it does so the pressure communicated to the valve seat 29 steadily increases, also as previously described. This increases the force acting on the valve 21. When that force becomes sufficiently high, the valve 21 is forced off the seat 29 and some flow once again takes place through the valve seat 29 and the passages 26, 27 and 28. The pressure acting on area A2 of the main valve element 10 is now partially relieved, and the force acting on the main valve element 10 is stabilised. The valve 21 takes up an equilibrium position in which the forces acting on valve 21 are balanced, on one side by the spring 20 and on the other by the excess pressure created in region P1. This excess pressure is the amplitude of the generated pulse. Thus the pulse amplitude can be held essentially constant, and at the level desired for the application, over a wide range of flow rates.

In practice the events described above occur almost simultaneously. The valve 21 does not necessarily close fully and then re-open partially, but may achieve an equilibrium position with only a slight overshoot of that position. Also there are cases to be considered in which the main flow rate is too low or too high to fall within the working range of the control system. If the flow is too low, the pressure drop (P2−P1) will remain below the control range even during the pulse and the valve 21 will remain completely closed. If the flow is too high, the force acting on valve 21 will be great enough to compress control spring 20 fully: no relative movement will take place between valve 21 and valve 29, and no pulse will be generated.

When the pulse is to be terminated, the coil 13 is de-energised. The combined force, due to differential pressure, on pilot valve 21 and the return spring 16 causes the pilot valve 21 to retract. Full flow is re-established through the pilot valve and the pressure acting on area A2 falls. This restores the original force conditions on the main valve element 10, which now returns to its starting position, and the pressure pulse ends.

Tests conducted with one embodiment of the invention show that the pulse amplitude is closely controlled over a flow range of at least 3:1. For example in a test running at flows between 150 US gallons per minute and 600 US gallons per minute (570 l/m–2270 l/m) the pulse amplitude variation is no more than 1.5:1 instead of the expected uncompensated range of 7:1, which would be quite unsuitable in practice.

As an alternative to use of compression spring 20 (for pressure signal amplitude control), the flexible bellows 23 may be replaced by a floating piston assembly (not shown) through which the actuator shaft of the pilot valve extends.

Although not shown in the drawings, by-pass ports may be provided in the restrictor ring 9 in order to provide a primary pressure drop. The by-pass may be used to increase the flow capability, without having to change the size of the main valve parts. This-may be important, because it means that the central part of the pulse generator can be exchanged across different pipe bores; only the mounting components have to be changed.

The relative area of the by-pass ports may be of critical importance in a given flow situation. If the by-pass area is too large, there is insufficient initial pressure drop, the operation of the main valve becomes sluggish, and the pulse amplitude too low. If the by-pass area is too small, the flow velocity through the main valve becomes too great, causing rapid erosion.

A number of circumferential by-pass ports, one of which is shown at 9*a* in FIG. 4, may be provided and equipped with "lock-in" plugs that can easily be inserted or removed at the well site. By selecting the correct number of ports to remain open, the by-pass characteristics may be varied to suit the anticipated conditions.

The invention claimed is:

1. A pressure pulse generator for use in transmitting pressure signals to surface in a fluid-based drilling system, said generator being arranged in use in the path of a pressurized fluid to operate a drilling assembly and being capable of being actuated to generate pressure signals in such fluid for transmission to surface pressure monitoring equipment, in which the pulse generator comprises:

a housing positionable in the path of the supply of pressurized fluid, said housing having an inlet anangement for admitting a portion of the fluid to the interior of the housing, and an outlet arrangement for discharging fluid from the interior of the housing for supply of the drilling assembly;

a control element slidably mounted in the housing for movement between an open and a closed position with respect to said inlet anangement, said control element being operative to generate a pressure pulse in the supply of pressure fluid when the control element takes-up the closed position;

a control passage extending through the control elements and closable by a pilot valve element arranged to be exposed to the pressure of the fluid in the passage; and an actuator coupled with the valve element and operative, when the pressure generator is activated to generate a pressure signal, to move the valve element to a position closing said passage and thereby to cause movement of the control element towards the closed position;

in which the coupling between the actuator and the valve element includes a yieldable biasing element which provides control of the amplitude of the pressure signals produced by the generator.

2. A pressure pulse generator according to claim 1, in which the biasing element comprises a spring anangement.

3. A pressure pulse generator for use in transmitting pressure signals to surface in a fluid-based drilling system, said generator being arranged in use in the path of a pressurized fluid to operate a drilling assembly and being capable of being actuated to generate pressure signals in such fluid for transmission to surface pressure monitoring equipment, in which the pulse generator comprises:

a housing positionable in the path of the supply of pressurized fluid, said housing having an inlet arrangement for admitting a portion of the fluid to the interior of the housing, and an outlet anangement for discharging fluid from the interior of the housing for supply of the drilling assembly;

a control element slidably mounted in the housing for movement between an open and a closed position with respect to said inlet arrangement, said control element being operative to generate a pressure pulse in the supply of pressure fluid when the control element takes-up the closed position;

a control passage extending through the control elements and closable by a pilot valve element ananged to be exposed to the pressure of the fluid in the passage; and an actuator coupled with the valve element and operative, when the pressure generator is activated to generate a pressure signal, to move the valve element to a position closing said passage and thereby to cause movement of the control element towards the closed position;

in which the coupling between the actuator and the valve element includes a yieldable biasing element which provides control of the amplitude of the pressure signals produced by the generator, in which the biassing element comprises a floating piston assembly incorporated within an actuator link between the actuator and the valve element.

4. A pressure pulse generator according to claim 1 in which the inlet anangement comprises a ring mounted internally of the housing at an upstream end thereof, and which defines a restricted inlet passage with the valve element.

5. A pressure pulse generator according to claim 4, in which a set of rings is provided, having different internal bores, and selectable for use according to by-pass requirements.

6. A pressure pulse generator according to claim 4, in which the ring includes at least one by-pass port.

7. A pressure pulse generator according to claim 1, in which the actuator comprises an electromagnetic actuator, and the coupling comprises a first actuator shaft connected to the actuator a second actuator shaft connected to the valve element, and with said yieldable biasing element located between first actuator shaft and the second actuator shaft.

8. A pressure pulse generator according to claim 3 in which the inlet arrangement comprises a ring mounted internally of the housing at an upstream end thereof, and which defines a restricted inlet passage with the valve element.

9. A pressure pulse generator according to claim 8, in which a set of rings is provided, having different internal bores, and selectable for use according to by-pass requirements.

10. A pressure pulse generator according to claim 8, in which the ring includes at least one by-pass port.

11. A pressure pulse generator according to claim 3, in which the actuator comprises an electromagnetic actuator, and the coupling comprises a first actuator shaft connected to the actuator a second actuator shaft connected to the valve element, and with said yieldable biasing element located between first actuator shaft and the second actuator shaft.

* * * * *